US006575493B1

(12) United States Patent
Lowenstein

(10) Patent No.: US 6,575,493 B1
(45) Date of Patent: Jun. 10, 2003

(54) COLLAPSIBLE TROLLEY

(75) Inventor: Frank Lowenstein, Tsimshatsui (HK)

(73) Assignee: Marshmallow Ltd., Tortola (VG)

( * ) Notice: Subject to any disclaimer, the term of this patent is extended or adjusted under 35 U.S.C. 154(b) by 0 days.

(21) Appl. No.: 09/125,771

(22) PCT Filed: Feb. 24, 1997

(86) PCT No.: PCT/GB97/00500

§ 371 (c)(1),
(2), (4) Date: Oct. 15, 1998

(87) PCT Pub. No.: WO97/30607

PCT Pub. Date: Aug. 28, 1997

(30) Foreign Application Priority Data

Feb. 24, 1996 (GB) ..... 9603965
Oct. 16, 1996 (GB) ..... 9621606

(51) Int. Cl.[7] ..... A45C 13/00

(52) U.S. Cl. ..... 280/655.1; 280/37; 280/39; 280/47.315; 280/655; 190/18 A

(58) Field of Search ..... 280/37, 38, 39, 280/655, 655.1, 47.26, 47.315; 16/114.1, 405, 429; 190/18 A

(56) References Cited

U.S. PATENT DOCUMENTS

| | | | | | |
|---|---|---|---|---|---|
| 1,495,752 | A | * | 5/1924 | La Rue | 16/405 |
| 3,141,680 | A | | 7/1964 | McCord et al. | |
| 3,934,895 | A | * | 1/1976 | Fox | 280/47.26 |
| 4,139,084 | A | * | 2/1979 | Linke | 190/48 |
| 4,284,287 | A | * | 8/1981 | Esposito | 280/655 |
| 4,411,343 | A | | 10/1983 | Cassimally et al. | |
| 4,616,379 | A | | 10/1986 | Lio | |
| 4,618,035 | A | | 10/1986 | Mao | |
| 4,915,408 | A | * | 4/1990 | Clemence et al. | 280/655 |
| 5,257,800 | A | | 11/1993 | Yang | |
| 5,291,976 | A | | 3/1994 | Ku | |
| 5,295,565 | A | | 3/1994 | Latshaw | |
| 5,355,980 | A | | 10/1994 | Hsieh | |
| 5,374,073 | A | | 12/1994 | Hung-Hsin | |
| 5,407,040 | A | | 4/1995 | Hu | |
| 5,421,605 | A | | 6/1995 | Chen | |
| 5,428,868 | A | | 7/1995 | Safdeye et al. | |
| 5,431,262 | A | | 7/1995 | Rekuc et al. | |
| 5,437,367 | A | | 8/1995 | Martin | |
| 5,452,778 | A | | 9/1995 | Wang | |
| 5,476,163 | A | | 12/1995 | Wu | |
| 5,482,147 | A | | 1/1996 | Wang | |
| 5,485,922 | A | | 1/1996 | Butcher | |
| 5,526,908 | A | * | 6/1996 | Wang | 190/115 |
| 5,533,601 | A | | 7/1996 | Wang | |
| 5,645,146 | A | * | 7/1997 | Bieber et al. | 190/18 |
| 5,653,319 | A | * | 8/1997 | Wang | 190/115 |
| 5,819,891 | A | * | 10/1998 | Wang et al. | 190/18 A |

FOREIGN PATENT DOCUMENTS

| | | |
|---|---|---|
| DE | 23 60 272 | 3/1975 |
| DE | 23 59 229 | 6/1975 |
| DE | 195 25 571 | 1/1996 |
| FR | 2 661 807 | 11/1991 |
| FR | 2 723 061 | 2/1996 |
| GB | 2 290 952 | 1/1996 |
| WO | WO 91/11126 | 8/1991 |
| WO | WO 92/19122 | 11/1992 |
| WO | WO 94/13170 | 6/1994 |

* cited by examiner

*Primary Examiner*—Avraham Lerner
(74) *Attorney, Agent, or Firm*—Merchant & Gould P.C.

(57) ABSTRACT

A grasping device for a case standing on rollers or the like is attached to a frontal surface of a case. In order to design the grasping device in such a way that the case is easy to transport and it is reliably prevented from tipping even when the direction of travel changes, the grasping device has a rod which can be withdrawn vertically from the front of the case and a handle attached to the free end of the rod.

1 Claim, 8 Drawing Sheets

COLLAPSIBLE TROLLEY

Figure 1:
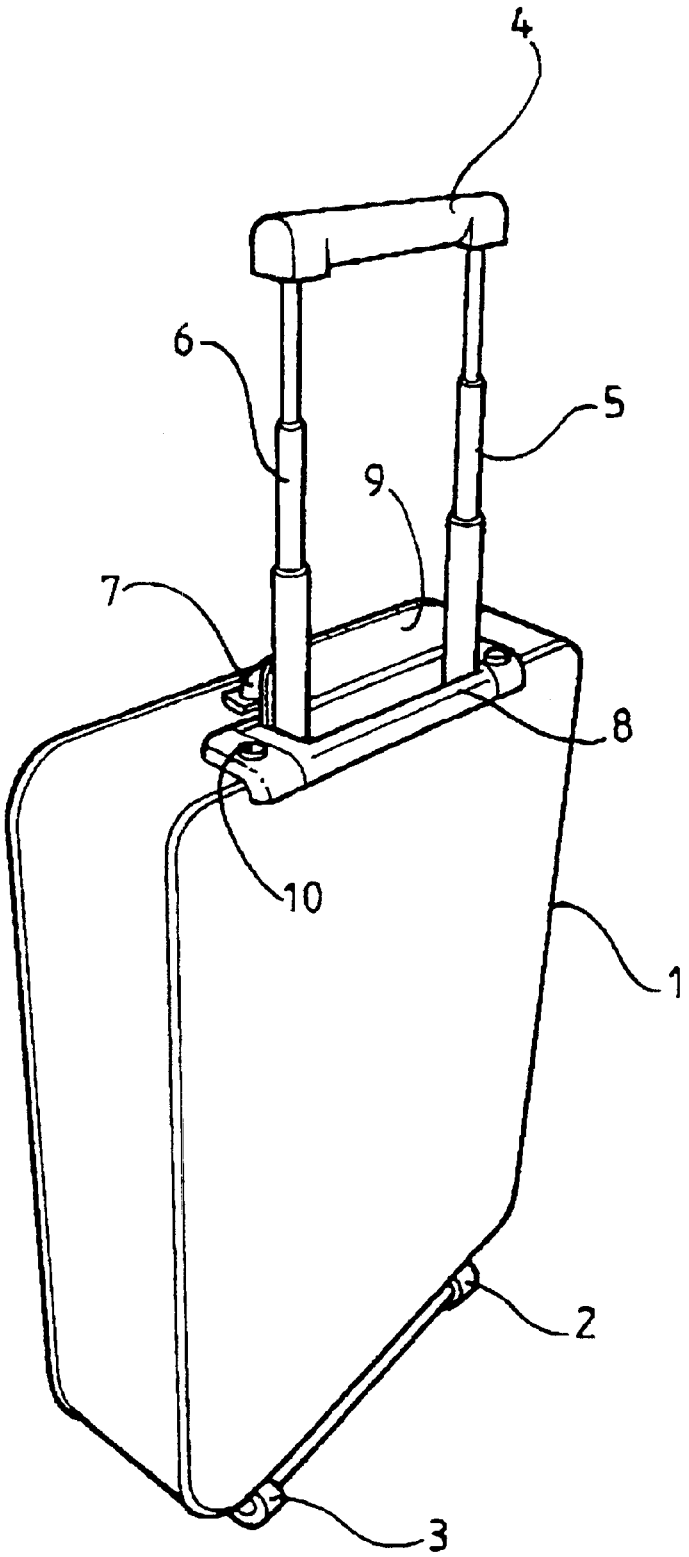

This invention relates to collapsible luggage trolleys of the type which include an item of luggage, such as a suitcase, which incorporates a conventional handle for carrying the luggage, and a set of wheels by which the luggage may alternatively be towed with the aid of a collapsible handle or similar arrangement.

Luggage trolleys of this type may be either soft-sided or hard-sided i.e. typically made of a rigid plastics material designed to withstand shock and thereby prevent or inhibit damage to the contents of the item of luggage. If the luggage is of the soft-sided variety then the wheels are normally attached to a rigid tubular structure on the other end of which is a handle which may be telescoped outwards for use or may be stored inside or outside one side of the luggage so that it can be carried by the hand by means of a conventional handle or stored away, for example, in the baggage compartment of an aeroplane. With certain known kinds of hard-sided luggage the tubular frame is inserted within the inner wall of one side of the luggage so that only the handle and the wheels at respective upper and lower ends of the luggage are visible externally. If the luggage is required to be towed it is a simple matter to remove the handle from its stored position and telescope it outwardly so as to permit the user to easily tow the luggage along the ground by use of the wheels.

A disadvantage of such known kinds of collapsible luggage is that they all rely upon the ability of the handle to be telescoped outwardly for use or telescoped inwardly for storage.

Because light weight is essential the telescopable tubes attached to the handle for this purpose are usually made of aluminum or a similarly lightweight material. Especially where the luggage is of the soft-side type and the telescopable tubes are on the outside of the luggage, they are prone to damage such that the handle may be difficult to telescope outwardly into its usable position, or if the damage has occurred whilst it has been so extended, difficulty arises in restoring the handle to its stored position.

Even with hard-sided luggage this problem is not entirely alleviated because carelessness in loading or unloading items from the inside of the luggage may result in damage to the tubular members.

A further disadvantage of such known types of luggage trolleys is that the tubular members are somewhat unsightly and also take up additional space which may otherwise be used for storing items inside the luggage, or for reducing the amount of total space the luggage takes in a storage compartment, such as the baggage compartment of an aeroplane if the tubular members are on the outside.

It is an object of the present invention to obviate or eliminate the foregoing disadvantages.

According to the invention, there is provided a luggage trolley comprising an item of luggage, wheel means disposed on one side and at one end of the luggage and adapted to permit the luggage to be towed when tilted, and a collapsible handle secured to at least one telescopable member and disposed at or near the end of the luggage remote from the wheel means, characterised in that the trolley comprises or includes a generally rigid housing adapted to be secured to the luggage for containing or including the handle and the at least one telescopable member, the handle being movable between a stored position inside or adjacent to the housing, in which position the or each telescopable member is substantially protected by the housing, and an extended position in which the handle may be used for towing the item of luggage via the wheel means.

Preferably, the housing is of hard rigid plastics material and includes an openable upper lid which is spring biased into a closed position so that when the or each telescopable member and the handle are in their stored positions within the housing, they are not visible when the lid is closed. In an alternative embodiment, the handle may be permanently exposed on the outer surface of the housing which may preferably be formed with recesses which permit the handle to be stored in a contiguous manner so that it does not protrude from the housing itself. Preferably, with such an arrangement the housing also includes additional recesses to permit the user of the handle to grasp it and move it from its stored position to its working position. Conveniently, the handle may include hinge means so that it may be hinged outwards from the housing and then pulled upwards along the or each telescopable member.

Where the housing is to be used with hard-sided luggage, it may conveniently be affixed to the outside thereof, or alternatively affixed to an inner surface of the luggage adjacent an appropriately shaped aperture permitting the handle and the or each telescopable member to be moved from stored to open positions for use.

Where the item of luggage is of the soft-sided kind the housing may preferably be secured to a rigid support member secured to the inside or outside of the luggage between the housing and the to provide rigidity. It will be appreciated that because the housing separately protects the or each telescopable member that any damage caused to such a rigid support member will not affect the operability of the handle.

Figure 2:
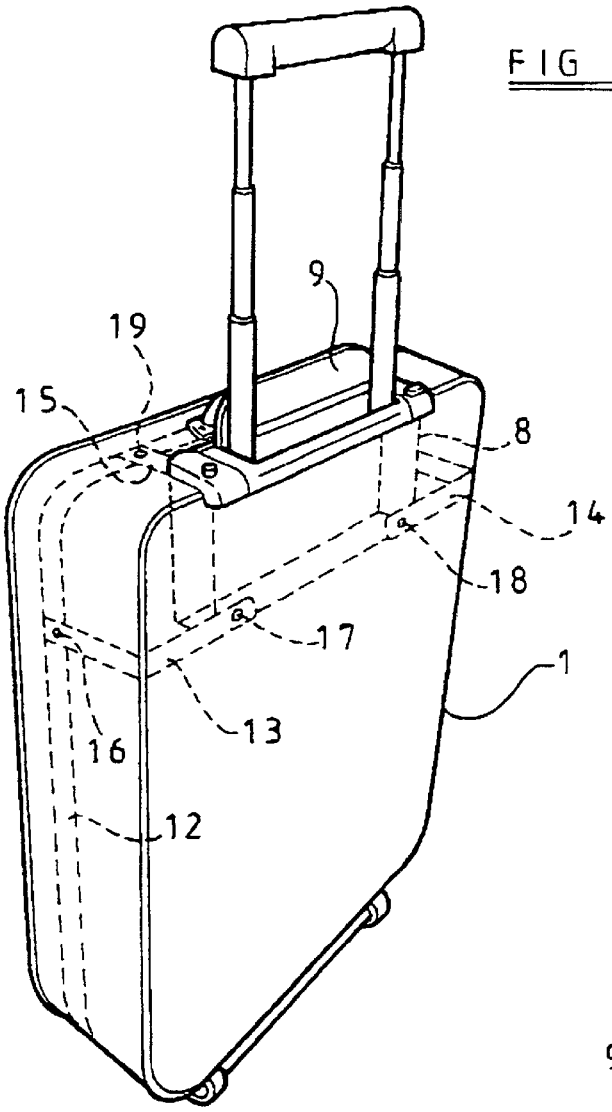
Figure 3:
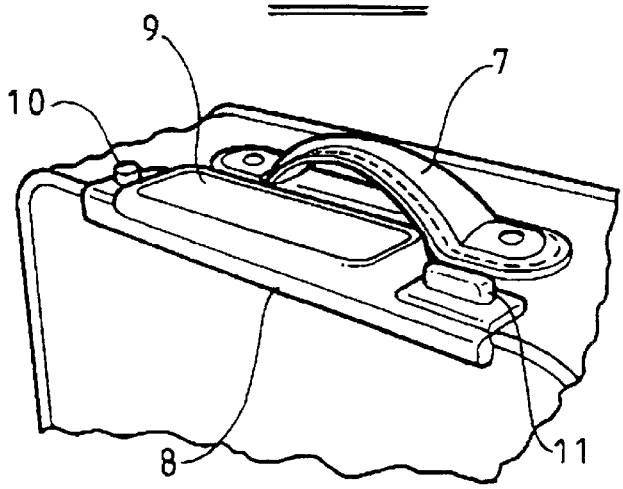
Figure 4:
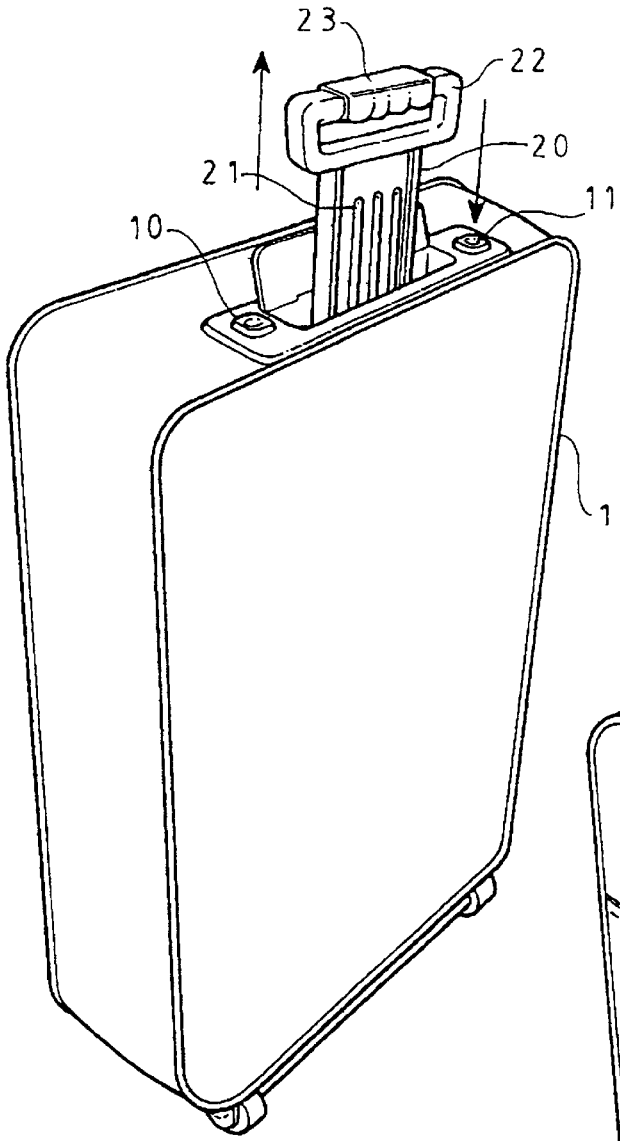
Figure 5:
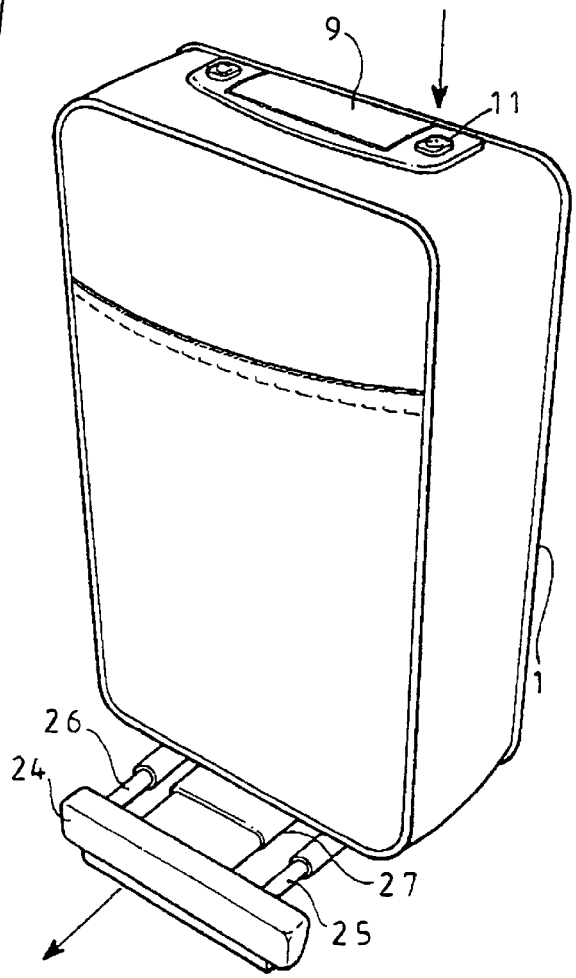
Figure 6:
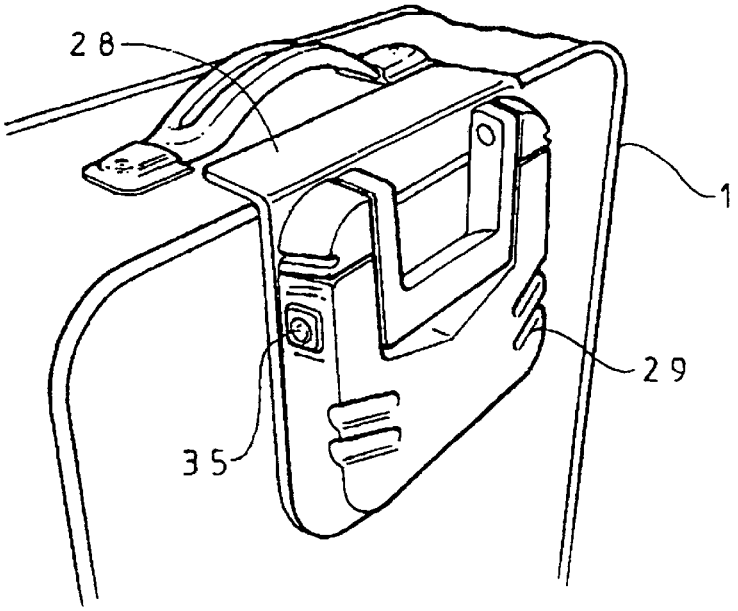
Figure 7:
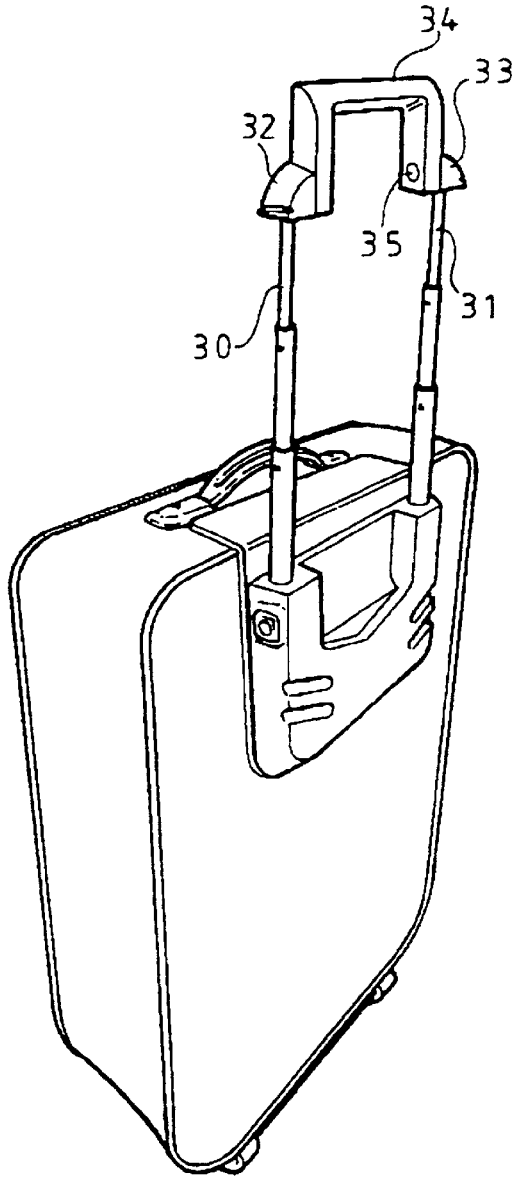
Figure 8:
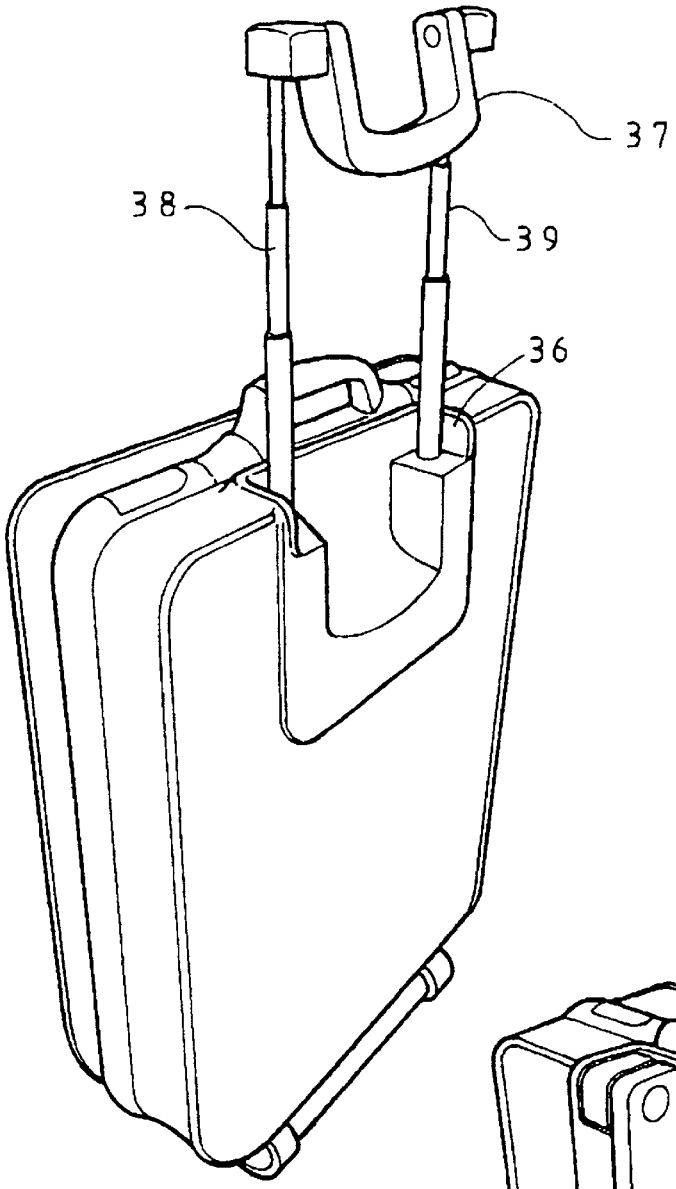
Figure 9:
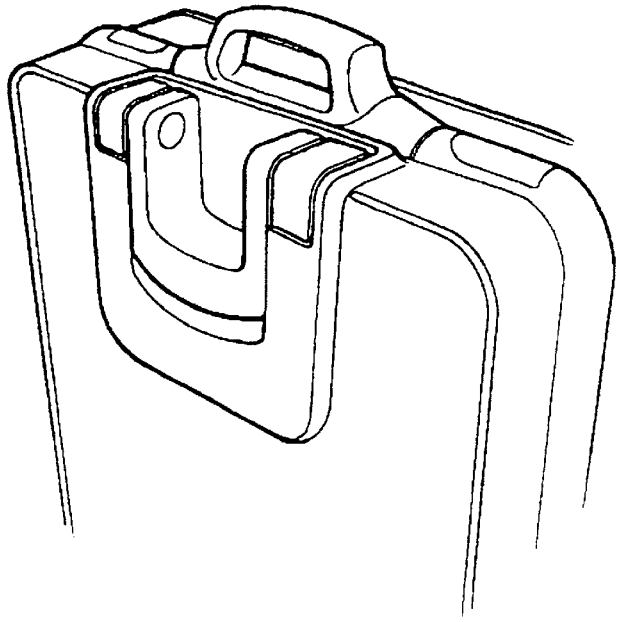
Figure 10:
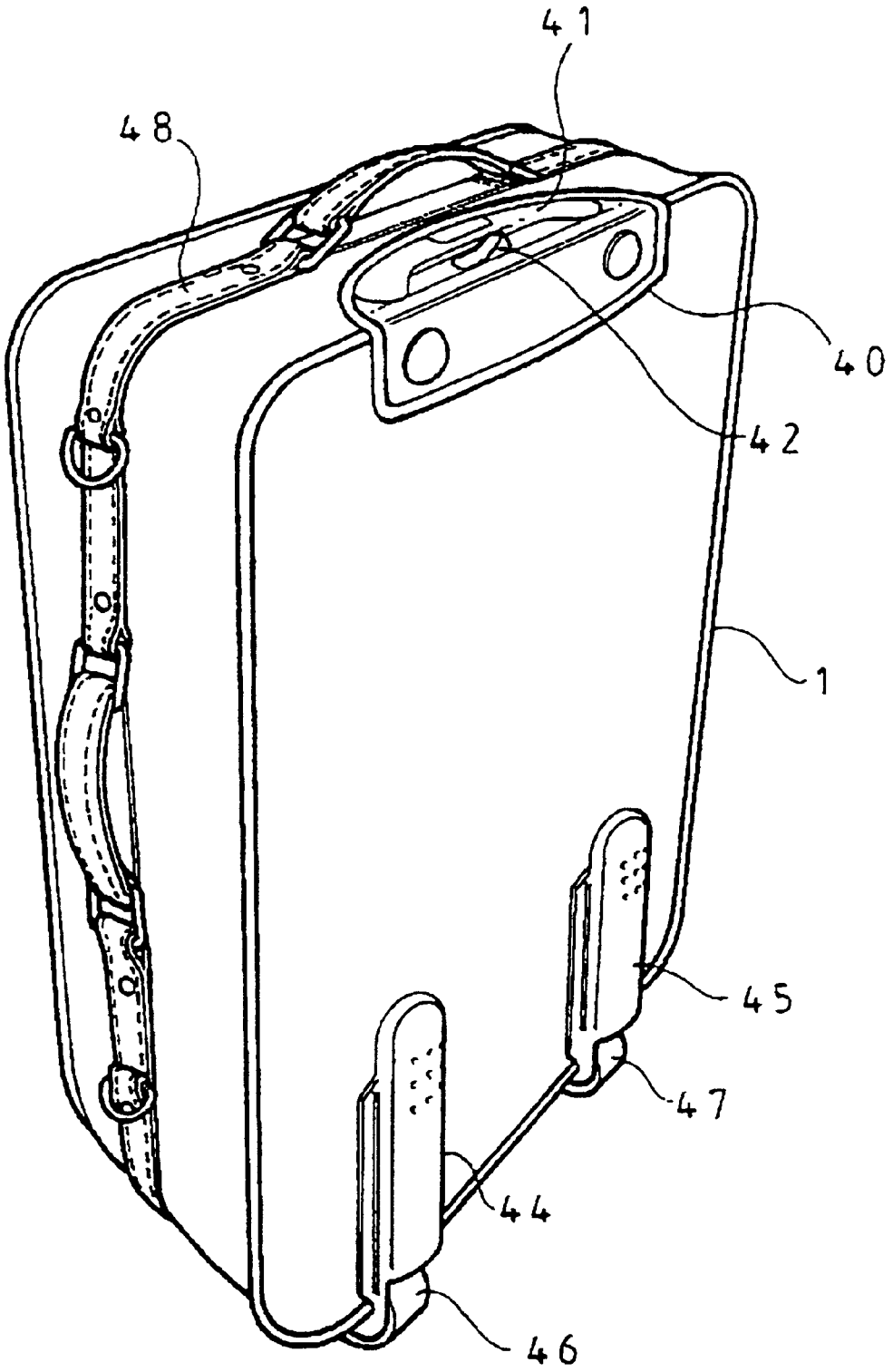
Figure 11:
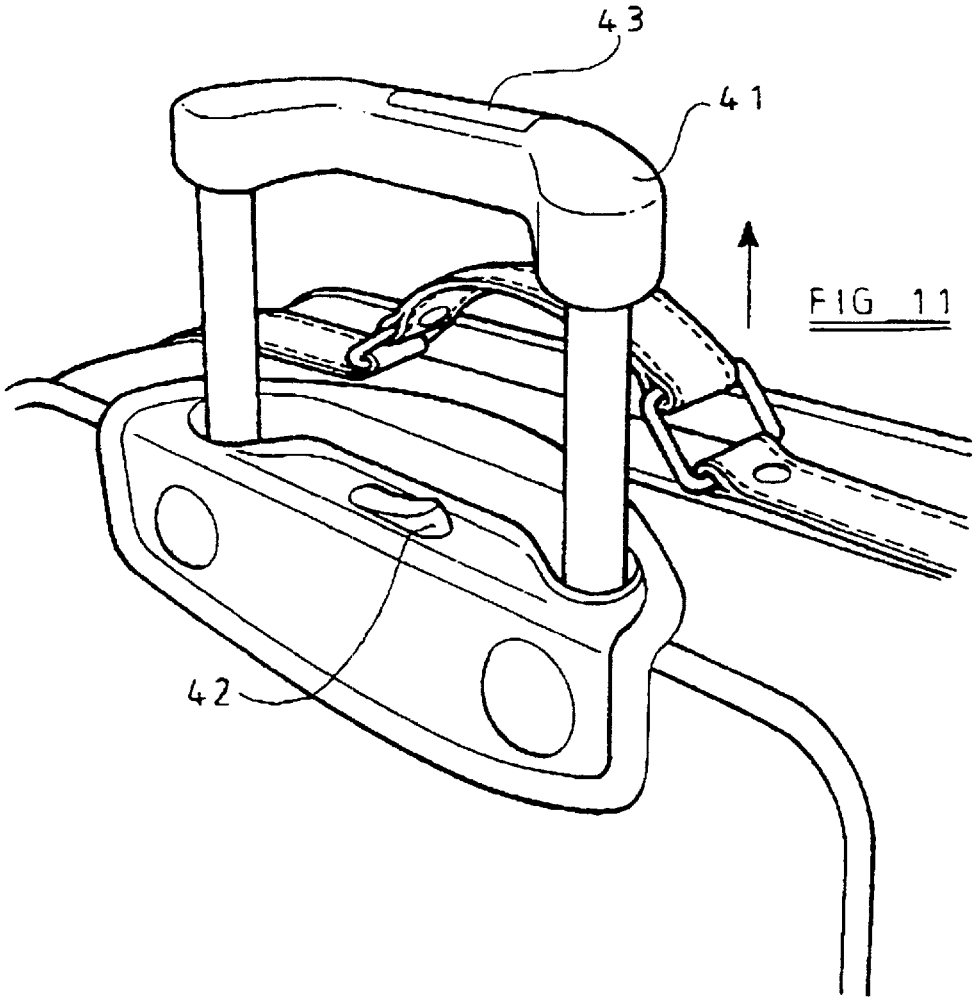
Figure 12:
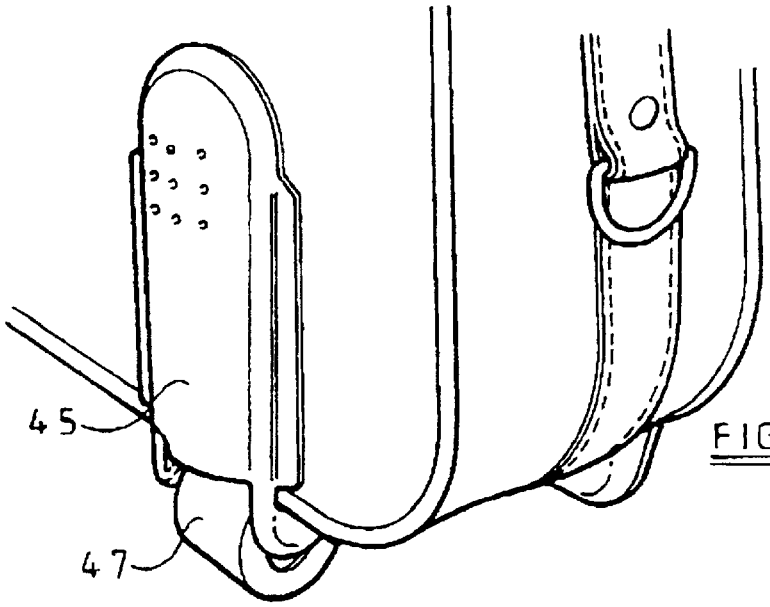
Figure 13:
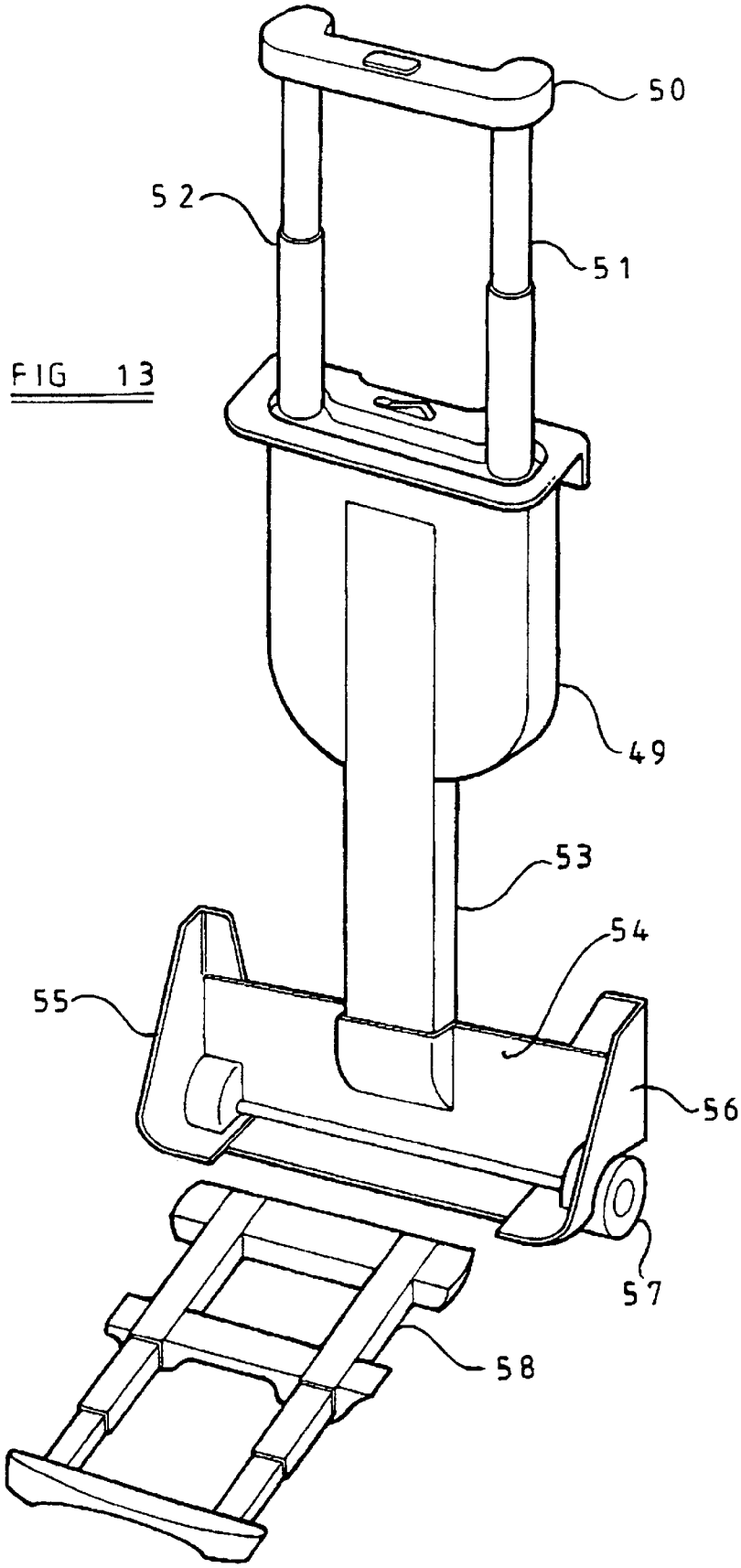

The invention will now be described, by way of example only, with reference to the accompanying drawings in which:

FIG. 1 is an upper perspective view from the rear and one side of a luggage trolley in a first embodiment FIG. 2 is a part-sectional view corresponding to that of FIG. 1 showing the general configuration of the handle means and how it is attached to the inside of the item of luggage, FIG. 3 is a detailed drawing of the upper end of the luggage trolley of FIG. 1 in which the handle has been collapsed inwardly, FIG. 4 is a view similar to that of FIG. 1 but showing a second embodiment of the invention, FIG. 5 is a view corresponding to that of FIG. 4 but in which the handle is shown in its stored position, FIG. 6 shows a third embodiment of the invention, FIG. 7 is a perspective view of the luggage trolley of FIG. 6 showing the handle means in its operable and fully extended position, FIG. 8 is a perspective of a fourth embodiment of the invention, FIG. 9 is a perspective view of the luggage trolley of FIG. 8 showing the collapsible handle in its stored position relative to the housing, FIG. 10 shows a perspective view of a fifth embodiment of the invention, FIG. 11 is a part perspective detail view of the handle and housing means of FIG. 10, FIG. 12 is a part perspective detail showing a wheel housing of the luggage of FIG. 10, and FIG. 13 is a part cut-out perspective view of a sixth embodiment of the invention.

Referring firstly to FIGS. 1–3, a first embodiment of the invention is shown in which the collapsible luggage trolley comprises a generally rectilinear item of soft-sided (i.e. non-rigid) luggage 1 having at its lower end a pair of coaxial wheels 2, 3 and at its upper end a collapsible handle 4 secured to a pair of telescopable members 5, 6 each in the form of three concentric tubes having cooperable flanges (not shown) by which the members 5, 6 are limited as to the extent of their axial movement in the manner as shown in the drawings.

A conventional handle 7 is secured to the upper surface of the item of luggage 1 so that it may be carried rather than rolled by the wheels 2, 3, if preferred.

The collapsible handle 4 and tubular members 5, 6 are each receivable within a generally rigid hollow plastics housing 8 which includes an openable upper lid 9 hinged to the side of the housing 8 adjacent to the handle 7 and spring-biased to normally remain in the closed position shown in FIG. 3.

The tubular members 5, 6 are biased by spring means (not shown) to the positions shown in FIGS. 1 and 2 and may be closed by means of a locking button 10 on the upper surface of the housing 8, depression of which permits the collapsible handle 4 and tubular members 5, 6 to be pushed downwardly into the housing 8 to the extent that the lid 9 is able to assume a closed position as shown in FIG. 3. Similarly, on the opposite upper surface of the housing 8 is a further button 11, depression of which unlocks the spring bias to allow the collapsible handle 4 and tubular members 5, 6 to automatically move upwardly with respect to the item of luggage 1 to assume the position shown in FIGS. 1 and 2.

Turning now to FIG. 2, there is shown the means by which the housing 8 is prevented from rocking relative to the soft-sided item of luggage 1. This is achieved with the aid of spring steel bands 12, 13, 14, 15 which are secured to the inner surface of the item of luggage 1, respective ends of the housing 8 and with respect to each other by means of rivets 16, 17, 18, 19. Only some of the steel bands and rivets are shown in the drawing for clarity but corresponding features are also present on the opposite side of the luggage trolley to that shown in section.

It will therefore be understood that the structure defined by the steel bands 12, 13, 14, 15 and the rigid plastics housing 8 is sufficiently rigid in itself to permit the handle 4 and tubular members 5, 6 to be prevented from rocking relative to the major plane of the item of luggage 1. Since, when not in use, the tubular members 5, 6 are protected by means of the rigid plastics housing 8, any damage caused through any other part of the item of luggage 1, such as to part of steel band 12, will not affect the general ability of the luggage trolley to operate in the manner required of it.

Turning now to FIGS. 4 and 5 there is shown an alternative embodiment of that shown in FIGS. 1 to 3 in which in this instance the item of soft-sided luggage 1 has collapsible handle means corresponding to that shown in FIGS. 1 to 3 but in which only one telescopable member 20 is provided in which the telescopable segments are generally flattened concentric tubes, on the major surface of each of which are corrugations 21 which improve the strength of the telescopable member 20. In this embodiment the collapsible handle 22 is in the shape of a large horizontally disposed chain link which incorporates in the central portion thereof sufficient space for the fingers of one hand of the user of the luggage to be inserted, and also incorporates on the upper portion thereof a rubber grip 23 having indentations corresponding to those of a hand. Apart from these differences the collapsible handle means operates in the same way as that shown in FIGS. 1 to 3 and depression of the locking button 10 permits the handle 22 and telescopable member 20 to assume the position shown in FIG. 4 with button 11 permitting upon depression thereof the reverse sequence whereby the handle 22 and telescopable member 20 may assume a position inside the housing and the lid 9 assume its closed position, as shown in FIG. 5.

In FIG. 5 there is also shown a further refinement of the second embodiment of the invention in which a spring biased collapsible bottom rail 24 is secured to telescopable members 25, 26 each comprising a pair of circular concentric tubes and for additional strength there is a central tubular member 27 in the form of a pair of generally flattened tubes.

Between the button 11 and bottom rail 24 is a cable (not shown) which provides that the bottom rail 23 may only be moved from its stored to the open position shown in FIG. 5 when button 11 is pressed.

Turning now to FIGS. 6 and 7 there is shown a further alternative embodiment of the invention in which in this instance the collapsible handle means is secured to the outside of the item of soft-sided luggage on an L-shaped plate 28 secured by rivets to steel bands inside the item of luggage 1 in a similar manner to that shown in FIG. 2. In this embodiment the plastic housing 29 has a generally U-shaped appearance with each arm of the "U" being used to store telescopable members 30, 31, shown in FIG. 7. At the upper ends of each of the tubular members 30, 31 are respective hinge joints 32, 33 between each of which is swivellably secured a collapsible handle 34 by means of a pair of hinge pins 35 (only one of which is shown). The housing 29 includes a recess for receiving the handle 34 in a stored position as shown in FIG. 6, in which position it may be easily locked in place by locking formations (not shown). A release button 35 is provided to allow the handle 34 to become unlocked and assume the position shown in FIG. 7 once the telescopable members 30, 31 are fully extended.

Turning now to FIGS. 8 and 9 there is shown a still further alternative embodiment of the invention specifically adapted for hard-sided luggage of the type generally manufactured from rigid plastics. In this embodiment the collapsible handle means comprises a housing 36 generally similar to that shown in FIGS. 6 and 7 but secured within a correspondingly shaped aperture in the upper part of one half of the item of luggage 1. A swivellable handle 37 is again provided on the respective ends of tubular members of 38, 39 and arranged such that when in the stored position shown in FIG. 9 the handle 37 assumes a contiguous position relative to the rest of the housing 36. On the inside of the luggage 1 the part of the housing 36 not shown includes a smooth plastics cover which protects the tubular members 38, 39 from damage which may otherwise occur when loading or unloading items from the luggage 1. Because, in this embodiment, the item of luggage 1 is made of a hard-sided plastics material its inherent rigidity is sufficient to obviate the need to secure the housing 36 to other reinforcing means such as steel bands etc. This is particularly advantageous since the handle means is therefore essentially independent to the wheels and the rest of the luggage and because it is in modular form, damage to any other part of the luggage 1 will not affect its operability.

In FIGS. 10 to 12 a still further embodiment of the invention is shown in which the suitcase 1 is provided with a rigid plastics housing 40, again incorporating a slidable handle means 41 which is spring biased into its open position as shown in FIG. 11 but when not in use is stored in the closed position shown in FIG. 10 by means of a releasable catch operable by a toggle switch 42 which, when pressed, automatically releases the handle to the position shown in FIG. 11. On the upper surface of the handle 41 is a catch release button 43 such that to move the handle 41 into its closed position it is simply necessary to press the button 43 and push down the handle 41 into its closed position until it is locked in place.

A further feature of the suitcase shown in FIGS. 10–12 is a pair of elongate rigid plastics wheel housings 44, 45 at the lower end of the suitcase which provide two functions, the first being support and protection for respective wheels 46, 47. The second function serves to protect the side of the suitcase 1 shown from damage when it is being rolled up or down stairs since the wheel housings 44, 45 are sufficiently long enough to ensure that when the suitcase 1 is tilted they protect it from shock or abrasion by contact with the leading edges of the stairs.

A still further feature of the embodiment shown in FIGS. 10–12 is a continuous strap 48 fixed by rivets to the outer side panels of the suitcase 1 incorporating handles and buckles by which the suitcase 1 may be carried in a variety of configurations or to which other articles may be attached.

In FIG. 13 there is shown a further alternative embodiment of the invention but in which for clarity the suitcase is not shown. In this embodiment a protective plastics housing 49 for a handle 50 supported on telescopic members 51, 52 includes at the lower end thereof an elongated plastics support member 53 to provide rigidity to the otherwise non rigid structure of the suitcase. The lower end of the rigid support member 53 slots into a correspondingly shaped aperture in a generally L-shaped transverse plastics strut 54 on each end of which are respective plastics wheel housings 55, 56 for receiving respective wheels 57, only one of which is shown. It will be seen in this embodiment that the structure defined by the elements 49–57 correspond to a conventional two-wheeled trolley even though it is fitted within the structure defined by the otherwise conventional item of luggage. A bottom rail 58 is also provided which is secured to the underside of the item of luggage and may be telescoped outwardly so that additional items of luggage may be carried as required thereon. The invention in its several embodiments thus provides an elegant and simple solution to problems associated with damage to collapsible tubular members which are necessary in order to make it easy for the user to tow items of luggage via wheels. In particular, the use of a modular housing which may be fixed inside or outside the item of luggage provides that such may be easily adapted to fit luggage of all shapes and sizes and with consequent potential for savings on manufacturing costs, whilst at the same time permitting the standardization of various component parts and facilitating ease of repair in the event this becomes necessary.

What is claimed is:

1. A luggage trolley adapted to be secured to an item of luggage, the luggage trolley comprising:

a strut on each end of which are respective wheels;

a single elongated support member having a first end portion and a second end portion, the first end portion of the support member being fixedly connected to the strut, wherein the support member is disposed perpendicular to a longitudinal axis of the strut;

a single generally rigid housing member having a pair of spaced compartments each formed with a top opening and an elongated slot extending between the pair of spaced compartments, the elongated slot being formed with a bottom opening, the second end portion of the support member extending through the bottom opening and being received within the elongated slot; and a pair of telescopic members received within the pair of compartments and extending through the top openings, the pair of telescopic members having lower ends affixed within the pair of spaced compartments and upper ends attached to a handle, the pair of telescopic members and the handle being movable between a stored position substantially within the housing and an extended position in which the handle may be used for towing the item of luggage via the wheels.

* * * * *